US009216340B2

(12) United States Patent
DelGreco

(10) Patent No.: US 9,216,340 B2
(45) **Date of Patent: *Dec. 22, 2015**

(54) REMOVABLE AND REPLACEABLE PIVOTING DEVICE AND TRAINING APPARATUS FOR A BASEBALL BATTER USING THE PIVOTING DEVICE

(71) Applicant: Susan J DelGreco, South Orange, NJ (US)

(72) Inventor: Susan J DelGreco, South Orange, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/764,731

(22) Filed: Feb. 11, 2013

(65) Prior Publication Data

US 2014/0155199 A1 Jun. 5, 2014

Related U.S. Application Data

(63) Continuation-in-part of application No. 12/931,056, filed on Jan. 24, 2011, now Pat. No. 8,371,963.

(51) Int. Cl.
*A63B 69/00* (2006.01)

(52) U.S. Cl.
CPC ..... *A63B 69/0002* (2013.01); *A63B 2069/0008* (2013.01); *A63B 2209/00* (2013.01); *A63B 2209/10* (2013.01)

(58) Field of Classification Search
CPC ..... A63B 69/0002; A63B 69/3667; A63B 69/0075; A63B 69/0059; A63B 69/36; A63B 69/367; A63B 2069/0008; A63B 2069/0006; A63B 2069/00626; A63B 22/143
USPC ..... 473/452, 422, 451, 497, 218, 270, 272
See application file for complete search history.

(56) References Cited

U.S. PATENT DOCUMENTS

| | | | | |
|---|---|---|---|---|
| 2,189,613 | A * | 2/1940 | Paulsen | 473/270 |
| 3,352,559 | A * | 11/1967 | Larsen | 473/269 |
| 3,372,930 | A * | 3/1968 | Sertich | 473/452 |
| 5,037,094 | A * | 8/1991 | Johnson | 473/452 |
| 5,318,290 | A * | 6/1994 | Sawyer | 473/452 |
| 5,810,673 | A * | 9/1998 | Castleberry | 473/217 |
| 5,976,026 | A * | 11/1999 | Erb | 473/272 |
| 6,102,818 | A * | 8/2000 | Hamilton | 473/452 |
| 6,723,004 | B1 * | 4/2004 | Florian | 473/270 |
| 6,749,529 | B1 * | 6/2004 | Sobolewski | 473/451 |
| 6,945,883 | B1 * | 9/2005 | Williams et al. | 473/452 |
| 7,335,117 | B2 * | 2/2008 | Reason-Kerkhoff | 473/452 |
| 7,435,194 | B1 * | 10/2008 | Lewis | 473/454 |
| 8,371,963 | B2 * | 2/2013 | DelGreco et al. | 473/452 |
| 2003/0224882 | A1 * | 12/2003 | Mahoney | 473/452 |

* cited by examiner

*Primary Examiner* — Mitra Aryanpour
(74) *Attorney, Agent, or Firm* — Stephen P. Kearney

(57) ABSTRACT

The invention is a pivot device for use with baseball training devices. The pivot device is removable and replaceable to allow it to be cleaned to maintain proper functioning of the pivot device and/or to be replaced when the pivot device is worn out.

8 Claims, 2 Drawing Sheets

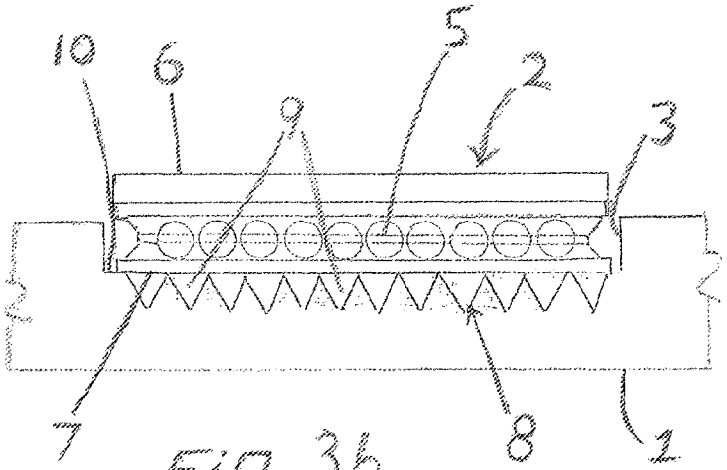
Fig. 3b
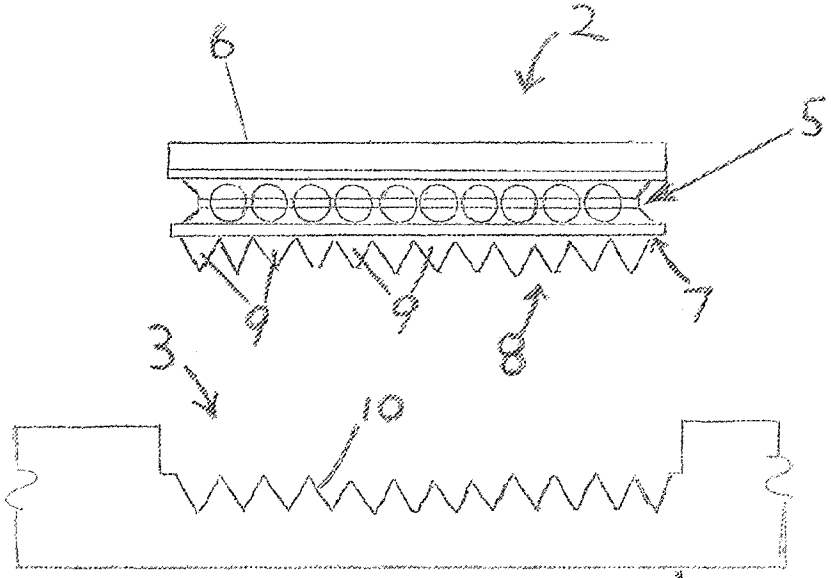
Fig. 3a
Fig. 3

REMOVABLE AND REPLACEABLE PIVOTING DEVICE AND TRAINING APPARATUS FOR A BASEBALL BATTER USING THE PIVOTING DEVICE

CROSS-REFERENCE TO RELATED APPLICATION

This application claims priority to and is a continuation-in-part of co-pending U.S. patent application Ser. No. 12/931,056, filed Jan. 24, 2011, by DelGreco et al., entitled PIVOTING TRAINING DEVICE FOR BASEBALL BATTER, which is incorporated herein by reference in its entirety.

FIELD OF THE INVENTION

The invention is a pivot device for use with baseball training apparatuses. The pivot device is removable and replaceable to allow it to be cleaned to maintain proper functioning of the pivot device and/or to be replaced when the pivot device is worn out.

BACKGROUND OF THE INVENTION

There are numerous training devices that are intended to aid in development of baseball hitting skills. Generally the prior training devices are used to support a baseball either in a fixed position or on a tether, so that a batter standing in position can practice swinging his bat to hit the ball. The prior training devices do not include any surface for the baseball batter to stand on; the baseball batter stands next to the training device on whatever surface is available. The prior training devices do not provide any direction or assistance to the baseball player regarding the player's stance, foot placement, or movement of feet and body during the swing.

Therefore, it is an objective of the present invention to provide a training apparatus that assists the baseball player in effective stance, foot placement, and movement of feet and body during the swing.

Because a baseball training apparatus is regularly subjected to sand, dirt, and mud, it is also an object of the present invention to provide a training apparatus that has a removable and replaceable pivot device.

It is also an object of the present invention to provide a pivot device that can be removed from a baseball training apparatus to be cleaned or replaced.

SUMMARY OF THE INVENTION

A training apparatus for baseball batters with a batters-box mat and rear foot pivot device is provided. In a preferred embodiment, toeholds for the front foot will also be provided. The baseball batter will stand on the mat with the rear foot resting on the pivot device and the front foot resting on the toehold. The baseball batter will practice pivoting his rear foot while swinging the baseball bat, in order to maximize effectiveness of the swing. The pivot device is removable so that it may be cleaned to maintain proper performance or so that the pivot device can be replaced when it is worn out.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

FIG. 3 is a sectional view of a preferred embodiment of the pivot device of the present invention wherein FIG. 3*a* shows the pivot device removed from the pivot recess and FIG. 3*b* shows the pivot device positioned within the pivot recess.

DETAILED DESCRIPTION OF THE INVENTION

Figure 1:
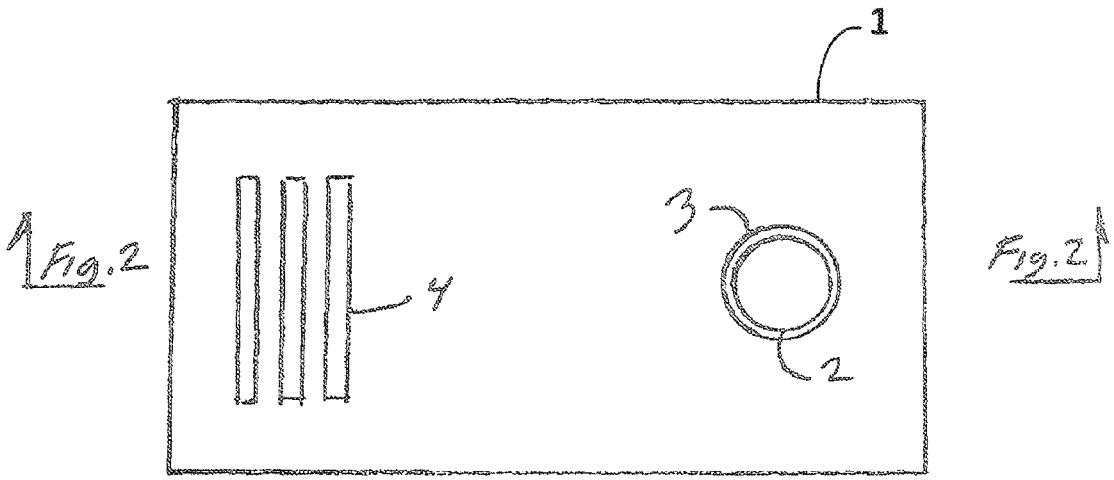
FIG. 1 is an overall plan view of a preferred embodiment of the present invention, showing the batters-box mat 1, the pivot device 2, the pivot recess 3, and the toeholds 4.
Figure 2:
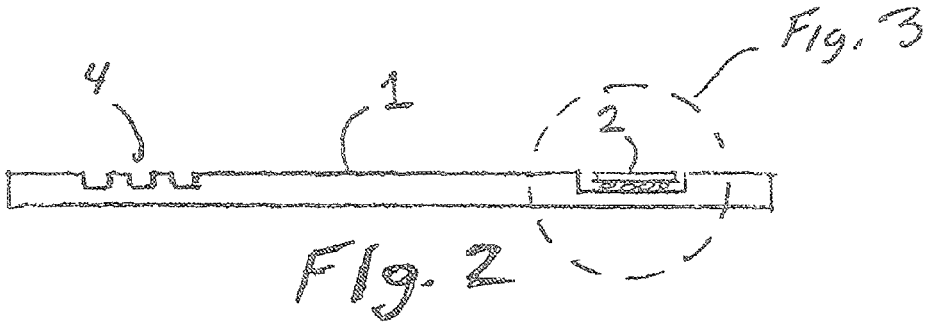
FIG. 2 is a sectional view of a preferred embodiment of the present invention.

A batters-box mat 1 contains a pivot device 2 which is mounted within a pivot recess 3. In a preferred embodiment the batters-box mat 1 is made of a flexible material such as rubber. In a preferred embodiment, the top surface of pivot device 2 is set at an elevation equal to the top surface of batters-box mat 1. In a preferred embodiment, pivot device 2 comprises a circular device with ball bearing that rotates freely about an axis perpendicular to the surface of batters-box mat 1. In a preferred embodiment, toeholds 4 are recessed into the top surface of batters-box mat 1. In a preferred embodiment there is more than one toehold, to allow for different stances of baseball batters.

The batters-box mat 1 can be used for both right hand and left hand batters. During training the batters-box mat 1 is placed in the batters-box, to the right or left of home plate according to whether the batter is right or left handed. The batters-box mat 1 is oriented such that the pivot device 2 is nearer the catcher and the toeholds 4 are nearer the pitcher. The baseball baiter stands on the batters-box mat 1 with his rear foot resting on the pivot device 2 and the front foot resting on a toehold 4. The baseball batter practices pivoting his rear foot on pivot device 2 while swinging the baseball bat, in order to maximize effectiveness of body rotation and bat swing.

Although the preferred embodiment includes flexible batters-box mat other embodiments are possible using rigid or semi-rigid mat material. Although the preferred embodiment includes pivot device with top surface set at al elevations equal to top of batters-box mat, other embodiments are possible using pivot device elevations below or above the top of batters-box mat. Although the preferred embodiment includes pivot device with ball bearing, other pivoting mechanisms such as roller bearing or lubricated slide bearing are possible. Although the preferred embodiment includes recessed holds, other embodiments are possible with raised toeholds, or no toeholds at all. Although the preferred embodiment does not include a home plate or any means of supporting a baseball in a position to be batted by batter, other embodiments are possible that would include a home plate and/or support for a baseball in position to be batted.

Referring to FIG. 3, the pivot device 2 of the present invention comprises a top surface 6, a bottom surface 7, and a bearing surface 5 positioned between said top surface 6 and said bottom surface 7. The bearing surface 5 will reduce friction between the bottom surface and the top surface 6 of the pivot device 2 such that the pivot device is capable of pivoting about an axis of rotation that is perpendicular to the top planar surface of the batters-box mat. The bearing surface 5 may be comprised of any means well known in the art for reducing friction between two surfaces. In a preferred embodiment, the bearing surface will comprise ball bearings positioned between two bearing surfaces or races.

The bottom surface 7 of the pivot device 2 will comprise a releasable securement means 8 joined thereto. As used herein, the term "joined" encompasses configurations whereby an element is directly secured to another element by affixing the element directly to the other element, and configurations whereby the element is indirectly secured to the other element by affixing the element to intermediate member(s) which in turn are affixed to the other element. The releasable securement means 8 will hold the pivot device 2 firmly within the pivot recess 3 during use yet will allow the pivot device to be readily removed from the pivot recess to be cleaned or to be replaced. The releasable securement means may be comprised of any number of securement means well known in the art that will hold the pivot device within the pivot recess during use yet allow the pivot device 2 to be removed when needed. For example, the releasable securement means may be comprised of a hook and loop fastening system, releasable pressure sensitive adhesives, or other such systems. In a preferred embodiment, the releasable securement means 8 will comprise a series of "teeth" or spikes joined to the bottom surface 7 of the pivot device 2. The teeth or spikes 9 will protrude from the bottom surface 7 of the pivot device 2 and will be capable of "biting" into the material (amalgam) of the batters-box mat 1 at the bottom of the recessed area 10.

What is claimed is:

1. A removable and replaceable pivot device for use with a baseball training apparatus having a recessed pivot area for receiving said pivot device, said recessed pivot area comprising a bottom surface, said pivot device comprising:

a top surface and a bottom surface, and being substantially circular in shape; a bearing surface positioned between said top surface and said bottom surface; said bottom surface being substantially complementary with said recessed pivot area and comprising a means for releasably securing said bottom surface to said bottom surface of said recessed pivot area.

2. The pivot device of claim 1 wherein said bearing surface comprises ball bearings positioned between two bearing races.

3. The pivot device of claim 1 wherein said means for releasably securing said bottom surface of said pivot device to said bottom surface of said recessed pivot area comprises teeth protruding from said bottom surface of said pivot device said teeth being capable of engaging the bottom surface of said recessed pivot area.

4. The pivot device of claim 3 wherein said teeth are comprised of a multiplicity of small steel spikes.

5. The pivot device of claim 3 wherein said teeth are comprised of a rigid polymeric material.

6. The pivot device of claim 1 wherein said means for releasably securing said bottom surface of said pivot device to said bottom surface of said recessed pivot area comprises a hook and loop fastening system comprising a hook portion and a loop portion and wherein the hook portion of said hook and loop fastening system is secured to the bottom surface of said pivot device and said loop portion is secured to the bottom surface of said recessed pivot area.

7. The pivot device of claim 1 wherein said means for releasably securing said bottom surface of said pivot device to said bottom surface of said recessed pivot area comprises a hook and loop fastening system comprising a hook portion and a loop portion and wherein the loop portion of said hook and loop fastening system is secured to the bottom surface of said pivot device and said hook portion is secured to the bottom surface of said recessed pivot area.

8. A baseball training apparatus having a releasable and replaceable pivot device, said apparatus comprising;

a batters-box mat defining a top planar surface, a forward edge, a rearward edge, and two lateral edges extending substantially perpendicularly, from said forward edge to said rearward edge on each side of said batters-box mat; said batters-bus. mat having a pitcher's end located toward the forward edge, and a catcher's end located toward the rearward edge, and having a recessed pivot arm, said recessed pivot area being located substantially toward the catcher's end of the batters-box mat, being substantially circular in shape, comprising a bottom surface, and being recessed from the top planar surface of the batters-box mat;

a pivot device comprising a top surface which is substantially level with the top planar surface of said batters-box mat, a bottom surface comprising a means for releasably securing said bottom surface of said pivot device to said bottom surface of said recessed pivot area, a bearing surface located between said top surface and said bottom surface, and being substantially complementary with said recessed pivot area, and being positioned within said recessed pivot area; and said pivot device being releasably secured to said bottom surface of said recessed pivot area.

* * * * *